US006676244B2

(12) United States Patent
Kwon et al.

(10) Patent No.: US 6,676,244 B2
(45) Date of Patent: Jan. 13, 2004

(54) BUBBLE-JET TYPE INKJET PRINTHEAD

(75) Inventors: Myung-jong Kwon, Seoul (KR); Yong-soo Oh, Seongnam (KR); Seog Soon Baek, Suwon (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 10/215,341

(22) Filed: Aug. 9, 2002

(65) Prior Publication Data

US 2003/0030697 A1 Feb. 13, 2003

(30) Foreign Application Priority Data

Aug. 9, 2001 (KR) ..... 2001-47958

(51) Int. Cl.[7] ..... B41J 2/135; B41J 2/14; B41J 2/16; B41J 2/05

(52) U.S. Cl. ..... 347/45; 347/47; 347/65

(58) Field of Search ..... 347/20, 56, 64, 347/63, 65, 67, 45, 47, 62

(56) References Cited

U.S. PATENT DOCUMENTS

| | | | | |
|---|---|---|---|---|
| 4,339,762 A | | 7/1982 | Shirato et al. | 347/62 |
| 4,643,948 A | * | 2/1987 | Diaz et al. | 347/45 |
| 4,847,630 A | | 7/1989 | Bhaskar et al. | 347/63 |
| 4,882,595 A | | 11/1989 | Trueba et al. | 347/92 |
| 4,990,939 A | * | 2/1991 | Sekiya | 347/64 |
| 5,367,324 A | * | 11/1994 | Abe et al. | 347/62 |
| 5,760,804 A | | 6/1998 | Heinzl | 347/56 |
| 5,850,241 A | | 12/1998 | Silverbrook et al. | 347/54 |
| 6,019,457 A | * | 2/2000 | Silverbrook | 347/65 |

FOREIGN PATENT DOCUMENTS

| | | | |
|---|---|---|---|
| EP | 317171 | 5/1989 | B41J/3/04 |

OTHER PUBLICATIONS

Tseng et al. A Novel Microinjector With Virtual Chamber Neck, 1998, pp. 57–62.

* cited by examiner

*Primary Examiner*—Juanita Stephens
(74) *Attorney, Agent, or Firm*—Lee & Sterba, P.C.

(57) ABSTRACT

A bubble-jet type inkjet printhead is disclosed, wherein a manifold for supplying ink, an ink chamber having a substantially hemispherical shape and filled with ink to be ejected, and an ink channel for supplying ink from the manifold to the ink chamber, are incorporated in a substrate. A nozzle plate having a nozzle, through which ink is ejected at the center of the ink chamber, is formed on the substrate. A heater is provided on the nozzle plate and surrounding the nozzle, and electrodes are provided on the nozzle plate and electrically connected to the heater to supply pulse current to the heater. An anti-wetting coating including a perfluorinated alkene compound on at least a surface around the nozzle is formed on an exposed surface of the printhead. Preferably, the anti-wetting coating is deposited by RF glow discharge and can be removed by $O_2$ plasma.

13 Claims, 6 Drawing Sheets

BUBBLE-JET TYPE INKJET PRINTHEAD

BACKGROUND OF THE INVENTION

1. Field of the Invention

The present invention relates to a bubble-jet type inkjet printhead. More particularly, the present invention relates to an inkjet printhead having a hemispherical ink chamber and an anti-wetting film.

2. Description of the Related Art

In general, inkjet printheads are devices for printing a predetermined image by ejecting small droplets of printing ink to desired positions on a recording sheet. Ink ejection mechanisms of an inkjet printer are generally categorized into two different types: an electro-thermal transducer type (bubble-jet type), in which a heat source is employed to form bubbles in ink causing an ink droplet to be ejected, and an electromechanical transducer type, in which an ink droplet is ejected by a change in ink volume due to deformation of a piezoelectric element.

There are multiple factors and parameters to consider in making an inkjet printhead having a bubble-jet type ink ejector. First, it should be simple to manufacture, have a low manufacturing cost, and be capable of being mass-produced. Second, in order to produce high quality color images, the formation of minute, undesirable satellite ink droplets that usually trail an ejected main ink droplet must be avoided. Third, when ink is ejected from one nozzle or when ink refills an ink chamber after ink ejection, cross-talk with adjacent nozzles, from which no ink is ejected, must be avoided. To this end, a back flow of ink in a direction opposite to the direction ink is ejected from a nozzle must be prevented during ink ejection. Fourth, for high-speed printing, a cycle beginning with ink ejection and ending with ink refill in the ink channel must be carried out in as short a period of time as possible. In other words, an inkjet printhead must have a high driving frequency.

The above requirements, however, tend to conflict with one another. Furthermore, the performance of an inkjet printhead is closely associated with and affected by the structure and design of an ink chamber, an ink channel, and a heater, as well as by the type of formation and expansion of bubbles, and the relative size of each component.

In an effort to overcome problems related to the above requirements, various inkjet printheads having different structures have already been suggested. However, while conventional inkjet printheads may satisfy some of the aforementioned requirements, they do not completely provide an improved inkjet printing approach.

FIG. 1 illustrates a cross-sectional view of a conventional bubble type inkjet printhead, schematically illustrating a back-shooting type ink ejector. In a back-shooting type printhead, bubbles grow in a direction opposite to a direction in which ink droplets are ejected.

As shown in FIG. 1, in the back-shooting type printhead, a heater 24 is arranged in the vicinity of a nozzle 22 formed on a nozzle plate 20. The heater 24 is connected to electrodes (not shown) for current application and is protected by a passivation layer 26 made of a predetermined material and formed on the nozzle plate 20. The nozzle plate 20 is formed on a substrate 10, and an ink chamber 12 is formed in the substrate 10 to correspond to the nozzle 22. The ink chamber 12 connected to an ink channel 14 is filled with ink 40. The surface of the passivation layer 26 for passivating the heater 24 is generally coated with an anti-wetting layer 30. The anti-wetting layer 30 prevents the ink 40 from adhering to the passivation layer 26.

In the above-described ink ejector, when current is applied to the heater 24, the heater 24 generates heat and bubbles 44 are produced in the ink 40 filling the ink chamber 12. Thereafter, the bubbles 44 continue to grow by the heat supplied from the heater 24. Accordingly, pressure is applied to the ink 40 so that the ink 40 near the nozzle 22 is ejected through the nozzle 22 in the form of an ink droplet 42. Then, the ink 40 is supplied to the ink chamber 12 through the ink channel 14 and the ink chamber 12 is refilled.

As described above, in order for the above-described bubble-jet type inkjet printhead to exhibit high quality printing, ink must be ejected in a stable manner, i.e., in the form of droplets. The size, form and surface quality of a nozzle are important factors that greatly affect the performance of the conventional bubble-jet type inkjet printhead, including the size of an ink droplet ejected, ejection stability and continuous ejection efficiency. In particular, the quality of a portion of the surface of the printhead near the nozzle greatly affects the ejection stability and continuous ejection efficiency.

Generally, if a nozzle and a portion of a surface of the printhead near the nozzle have an anti-wetting property, ink can be perfectly ejected in the form of an ink droplet. Accordingly, the accuracy in location of recording paper where an ink droplet lands and the uniformity in ink droplet dispersion are improved, thereby improving overall print quality. In addition, after ink ejection, a meniscus formed around the aperture of a nozzle is rapidly stabilized, thus preventing external air from being pulled back into the ink chamber and preventing a surface of the printhead around the nozzle from being contaminated.

Alternatively, if a portion of a surface of the printhead near the nozzle is not subjected to anti-wetting treatment, the portion is susceptible to contamination by ink or a foreign substance. Accordingly, print quality and efficiency may deteriorate. As shown FIG. 2, if the surface of the printhead around a nozzle 62 is not subjected to an anti-wetting treatment, a contact angle θ between an ink droplet 72 and the surface of the printhead is small, so that the ink droplet 72 tends to be easily spread on the surface near the nozzle 62. In this case, a desirably shaped ink droplet, such as the one illustrated in FIG. 1, is not formed, nor is a direction of an ink droplet ejection accurately maintained. Additionally, even after ink droplet ejection, ink may remain on the surface near the nozzle 62. If the surface near the nozzle 62 is stained with ink or a foreign substance, a sheet of recording paper may also be stained with the ink or foreign substance, resulting in poor print quality.

Accordingly, in order to improve the reliability and print quality of an inkjet printhead, it is necessary to subject a surface of a printhead to an anti-wetting treatment. As a coating for the anti-wetting treatment, a metal such as gold (Au), palladium (Pd) or tantalum (Ta) has been typically used. However, such a metal having a contact angle of less than 90° cannot be suitably used as a coating for an inkjet printhead that is required to have a high anti-wetting property.

SUMMARY OF THE INVENTION

In an effort to solve the above problems, it is a feature of an embodiment of the present invention to provide a bubble-jet type inkjet printhead having a hemispherical ink chamber and an anti-wetting film exhibiting good characteristics while satisfying general requirements of a printhead.

To provide the above feature, the present invention provides a bubble-jet type inkjet printhead including a substrate, in which a manifold for supplying ink, an ink chamber having a substantially hemispherical shape and filled with ink to be ejected, and an ink channel for supplying ink from the manifold to the ink chamber, are incorporated, a nozzle plate, formed on the substrate, having a nozzle, through which ink is ejected, the nozzle formed at a location corresponding to the center of the ink chamber, a heater provided on the nozzle plate and surrounding the nozzle, and electrodes provided on the nozzle plate and electrically connected to the heater to supply pulse current to the heater, wherein an anti-wetting coating including a perfluorinated alkene compound on at least a surface around the nozzle is formed on an exposed surface of the printhead.

Preferably, the perfluorinated alkene compound as an anti-wetting compound is perfluorobutene. Also preferably, the anti-wetting coating is deposited by RF glow discharge and can be removed by $O_2$ plasma.

Since an anti-wetting film having a perfluorinated alkene compound provided on the outer surface around a nozzle has a relatively large contact angle, ink ejection can be made in a more stable manner and more accurately. Thus, the reliability and print quality of the inkjet printhead can be improved.

Additionally, an insulation layer may be preferably formed on the nozzle plate where the heater is formed, and the electrodes are preferably formed on the insulation layer. Further, a passivation layer is preferably formed over the electrodes and the insulation layer, and the anti-wetting coating is preferably formed on the passivation layer.

The manifold may be formed on a bottom side of the substrate, and the ink channel may be formed on a bottom of the ink chamber to be in flow communication with the manifold.

Further, a nozzle guide extending downward in the depth direction of the ink chamber may be formed at an edge of the nozzle.

The heater is preferably annular-shaped, with the electrodes connected to opposite locations of the heater on the diameter thereof. Alternatively, the heater may be formed in the shape of the Greek letter omega and the electrodes are connected to both ends of the heater.

BRIEF DESCRIPTION OF THE DRAWINGS

The above features and advantages of the present invention will become readily apparent to those of ordinary skill in the art by describing in details preferred embodiments thereof with reference to the attached drawings in which.

DETAILED DESCRIPTION OF THE INVENTION

Figure 1:
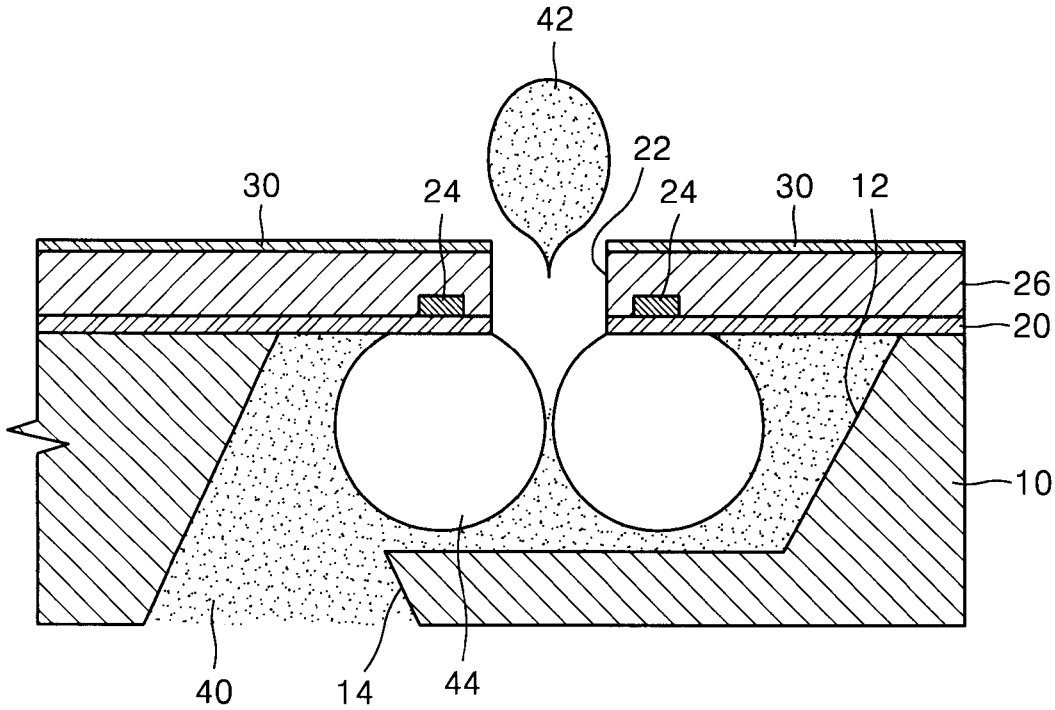
FIG. 1 (PRIOR ART)
FIG. 1 illustrates a cross-sectional view of an ink ejector of a conventional bubble-jet type inkjet printhead.

Korean Patent Application No. 2001-47958, filed Aug. 9, 2001, entitled: "Bubble-jet Type Inkjet Printhead," is incorporated by reference herein in its entirety.

The present invention will now be described more fully with reference to the accompanying drawings, in which preferred embodiments of the present invention are shown. This invention may, however, be embodied in many different forms and should not be construed as being limited to the embodiments set forth herein. Rather, these embodiments are provided so that this disclosure will be thorough and complete, and will fully convey the concept of the present invention to those of ordinary skill in the art. In the drawings, the shape and thickness of an element may be exaggerated for clarity, and like reference numerals appearing in different drawings represent like elements. Further, it will be understood that when a layer is referred to as being "on" another layer or substrate, it may be directly on the other layer or substrate, or intervening layers may also be present.

Figure 3:
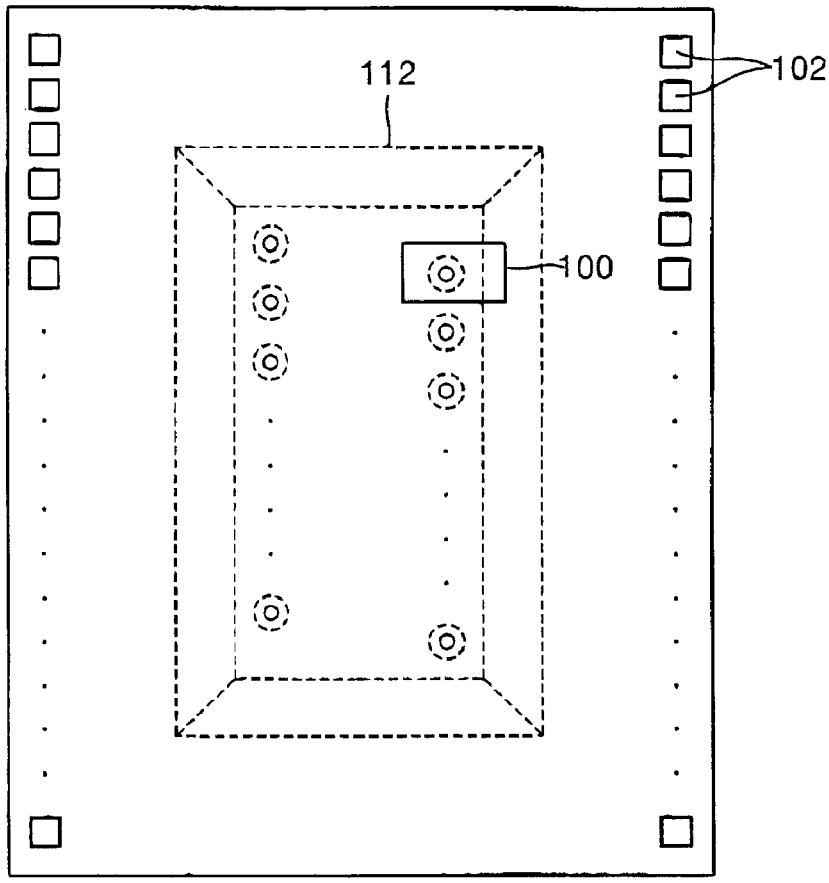
FIG. 3 illustrates a schematic plan view of an inkjet printhead according to an embodiment of the present invention.

FIG. 3 illustrates a schematic plan view of a bubble-jet type of inkjet printhead according to a first embodiment of the present invention.

Referring to FIG. 3, ink ejectors 100 are arranged in two rows in an alternating fashion on ink supplying manifold 112 marked by dotted lines on the inkjet printhead. Bonding pads 102, to which wires will be bonded, are arranged to be electrically connected to the ink ejectors 100. The manifold 112 is in flow communication with an ink container (not shown), which contains ink. In FIG. 3, the ink ejectors 100 are illustrated as being arranged in two rows, however, they may be arranged in a single row or three or more rows in order to further increase the resolution. In addition, the manifold 112 may be formed under each row of the ink ejectors 100. Although a printhead using only one color of ink is illustrated in FIG. 3, three or four groups of ink ejectors may be arranged in the printhead by color in order to print color images.

Figure 4:
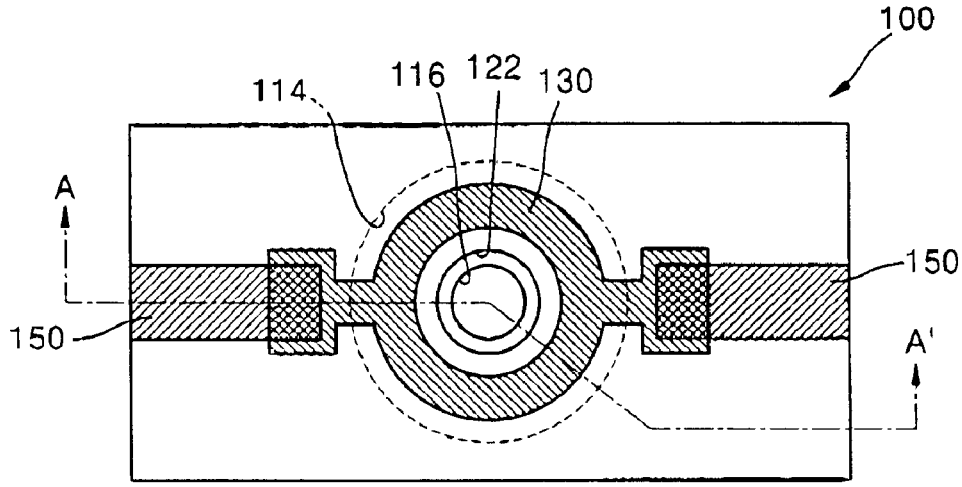
FIG. 4 illustrates an enlarged plan view of an ink ejector illustrated in FIG. 3.
Figure 5:
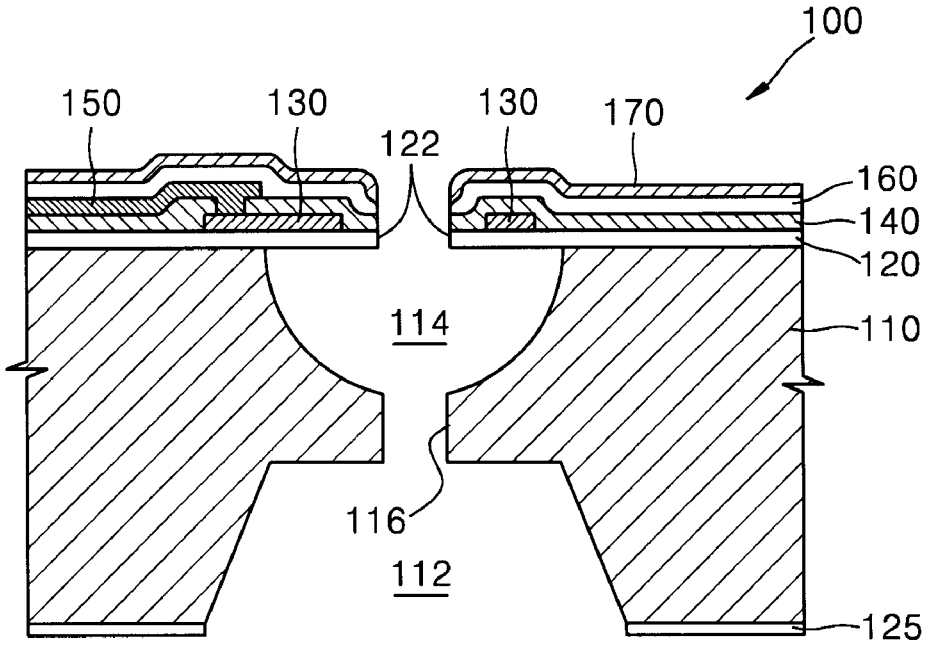
FIG. 5 illustrates a cross-sectional view of the vertical structure of an ink ejector according to a first embodiment of the present invention, taken along lines A-A' of FIG. 4.

FIG. 4 illustrates an enlarged plan view of the ink ejector illustrated in FIG. 3. FIG. 5 illustrates a cross-sectional view of the vertical structure of the ink ejector, taken along line A-A' of FIG. 4.

As shown in the drawings, an ink chamber 114, in which ink is filled, is formed on the surface of a substrate 110 in the ink ejector 100. The manifold 112 for supplying ink to the ink chamber 114 is formed on a bottom side of the substrate 110. An ink channel 116 connecting the ink chamber 114 and the manifold 112 is formed at a central bottom surface of the ink chamber 114. Preferably, the ink chamber 114 is substantially hemispherical.

Preferably, the substrate 110 is formed from silicon that is widely used in manufacturing integrated circuits. For example, a silicon substrate having a crystal orientation of (100) and having a thickness of about 500 $\mu$m may be used as the substrate 110. This selection is made because the use of a silicon wafer, which is widely used in the manufacture of semiconductor devices, allows for high volume production. The ink chamber 114 can be formed by isotropically etching the substrate 110 exposed through a nozzle 122 formed on a nozzle plate 120, which will be described later. The manifold 112 may be formed by obliquely etching or anisotropically etching the bottom of the substrate 110. Preferably, the ink chamber 114 is formed to have a substantially hemispherical shape of about 20 $\mu$m in depth and radius. Meanwhile, the ink chamber 114 may also be formed by anisotropically etching the bottom surface of the substrate 110 to predetermined depth, followed by isotropic etching. Additionally, the ink channel 116 may be formed by anisotropically etching a middle portion of the bottom of the ink chamber 114. In this case, the diameter of the ink channel 116 is equal to or slightly less than that of the nozzle 122. Since the diameter of the ink channel 116 affects a back flow of ink being pushed back into the ink channel 116 during ink ejection and the speed at which ink refills after ink ejection, it needs to be finely controlled when forming the ink channel 116.

The nozzle plate 120 having the nozzle 122 is formed on the surface of the substrate 110, forming the upper wall of the ink chamber 114. If the substrate 110 is formed of silicon, the nozzle plate 120 may be formed of a silicon oxide layer formed by oxidizing the silicon substrate 110. Specifically, a silicon wafer is put into an oxidization furnace and wet-oxidized or dry-oxidized to form an oxide layer on the top surface of the silicon substrate 110, thereby forming the nozzle plate 120. A silicon oxide layer 125 is also formed on the bottom surfaces of the silicon wafer 110.

A heater 130 for generating bubbles is formed around the nozzle 122 in a ring shape on the nozzle plate 120. This heater 130 is preferable formed of a circular ring shape and consists of heating elements such as polycrystalline silicon doped with impurities. Specifically, the impurity-doped, polycrystalline silicon layer may be formed by low pressure chemical vapor deposition (LPCVD) using a source gas containing phosphorous (P) as impurities, in which the polycrystalline silicon is deposited to a thickness of about 0.7 to 1 $\mu$m. The thickness to which the polycrystalline silicon layer may be deposited may be in different ranges so that the heater 130 may have appropriate resistance considering its width and length. The polycrystalline silicon layer deposited on the entire surface of the nozzle plate 120 is patterned into a circular ring shape by a photolithography process using a photo mask and a photoresist, and an etching process using a photoresist pattern as an etch mask.

A silicon nitride layer may be formed as an insulation layer 140 on the nozzle plate 120 and the heater 130. The insulation layer 140 may also be deposited to a thickness of about 0.5 $\mu$m using low pressure CVD.

Figure 2:
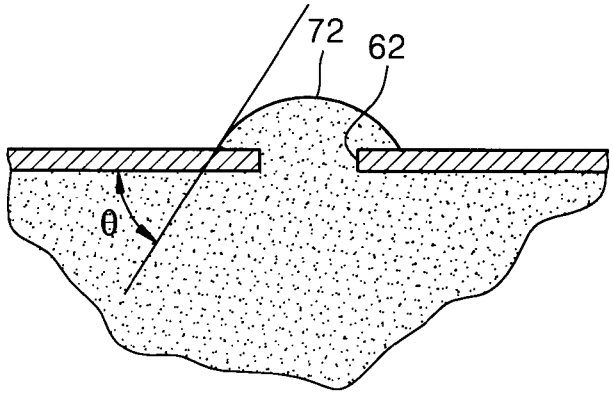
FIG. 2 (PRIOR ART)
FIG. 2 illustrates a diagram showing the state of an ink droplet in a case where the surface of the printhead around a nozzle is not subjected to an anti-wetting treatment.

Electrodes 150 for applying pulse current, which are typically formed of a metal, are connected to the heater 130. Here, the electrodes 150 are connected to opposite locations on the diameter of the heater 130. In detail, a portion of the insulation layer 140 formed of a silicon nitride layer, that is, a portion to be connected to the electrodes 150 on top of the heater 130, is etched to expose the heater 130. Next, the electrodes 150 are formed by depositing metal having good conductivity and patterning capability, such as aluminum or aluminum alloy, to a thickness of about 1 $\mu$m by sputtering, followed by patterning. In this case, metal layers forming the electrodes 150 are simultaneously patterned to form wiring lines (not shown) and the bonding pad (102 of FIG. 2) at other potions of the substrate 110.

A silicon oxide layer as a passivation layer 160 may be formed on the insulation layer 140 and the electrode 150. The silicon oxide layer 160 may be deposited by CVD to a thickness of about 1 $\mu$m at a relatively low temperature where the electrode 150 made of aluminum or aluminum alloy and the bonding pad are not deformed, for example, at a temperature not exceeding 400° C. Alternatively, the passivation layer 160 may be formed of a silicon nitride layer.

In a state in which the passivation layer 160 is formed, a photoresist pattern is formed on the entire surface of the passivation layer 160, followed by sequentially etching the passivation layer 160, the insulation layer 140 and the nozzle plate 120 using the photoresist pattern as an etching mask, thereby forming the nozzle 122 having a diameter of about 16–20 $\mu$m. The ink chamber 114 and the ink channel 116 are formed through the thus-formed nozzle 122.

An anti-wetting film 170 is formed on a top, exposed surface of the ink ejector 100. The anti-wetting film 170 is preferably formed on a portion of the surface around the nozzle. Here, the perfluorinated alkene is used as the anti-wetting film 170. Specifically, perfluorobutene is preferably used.

An anti-wetting coating on the surface of the inkjet printhead requires wear resistance, heat resistance and chemical resistance, as well as an anti-wetting property. The material that satisfies these requirements most is known as Teflon, which is a kind of heat-resistant resin. However, from the viewpoint of processing, it is difficult to directly use Teflon as an anti-wetting coating of a printhead due to its high hardness. Accordingly, in the present invention, a perfluorinated alkene compound, as described above, is used as a substitute material for Teflon.

The anti-wetting film 170 may be formed by a wetting-type method, such as spray coating or spin coating. However, the present invention employs dry-type deposition, in which RF glow discharge is performed on perfluorinated alkene monomer gas. After deposition, heat treatment may be accomplished for about 150 seconds on a hot plate as post-treatment for the purposes of strengthening the anti-wetting film 170 and improving adhesion between the anti-wetting film 170 and the substrate 110.

Meanwhile, the anti-wetting film 170 formed of a perfluorinated alkene compound can be removed by $O_2$ plasma. Deposition of the anti-wetting film 170 in a state in which the nozzle 122 and the ink chamber 114 have already been formed results in formation of a coating inside the ink chamber 114. However, such a coating formed where it is unnecessarily formed should be removed. Thus, the coating formed where it is unnecessarily formed, e.g., the coating formed inside the ink chamber 114, can be removed by injecting $O_2$ plasma gas into the ink chamber 114 through a manifold 112.

The anti-wetting film 170 containing the perfluorinated alkene compound has a static contact angle of about 115°, exhibiting superiority in anti-wetting property. In addition, the anti-wetting film 170 has hysteresis in dynamic contact angle of not greater than 30°, acquiring a uniform coating. The anti-wetting film 170 maintains thermal stability at a temperature of 200° C. for three hours. Although a slight reduction in thickness occurs after heat treatment, the anti-wetting film 170 shows little change in static contact angle and dynamic contact angle. Moreover, the anti-wetting film 170 is so superior in adhesiveness, with respect to a substrate, that it is not stripped off even by a UV tape test employed in dicing in the course of semiconductor manufacture. Even after the UV tape test, the anti-wetting property of the anti-wetting film 170 is not changed. Such properties of the anti-wetting film 170 according the present invention are exhibited irrespective of the kind of substrate used, that is, not only may a substrate be formed of silicon oxide or a silicon nitride material, but the substrate may also be formed of a metal, for example, gold (Au).

As described above, since the anti-wetting film 170 including a perfluorinated alkene compound has a relatively large contact angle, ink can be ejected in the form of a perfect ink droplet. Additionally, the print quality is improved by increasing the accuracy in the landing location of an ink droplet on recoding paper and spraying uniformity. In addition, after ink ejection, a meniscus formed around the aperture of a nozzle is rapidly stabilized, thus preventing external air from being pull back into the ink chamber and preventing a surface of the printhead around the nozzle from being contaminated.

Figure 6:
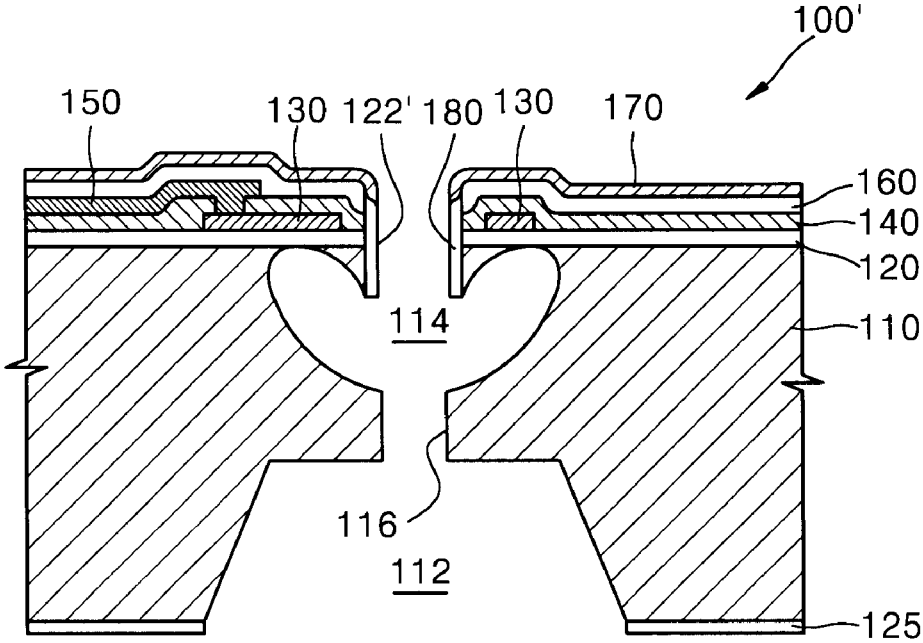
FIG. 6 illustrates a cross-sectional view of the vertical structure of an ink ejector according to another embodiment of the present invention.

FIG. 6 illustrates a cross-sectional view of the vertical structure of an ink ejector according to another embodiment of the present invention. Since this embodiment of the present invention is similar to the first embodiment, only differences between the two embodiments will now be described.

In an ink ejector 100' illustrated in FIG. 6, the bottom surface of an ink chamber 114 is substantially spherical, as described above. However, a nozzle guide 180 extending in a depth direction of the ink chamber 114 is formed from the edge of a nozzle 122'. The function of the nozzle guide 180 will later be described. The nozzle guide 180 and the ink chamber 114 may be formed at the same time. More specifically, a portion of the substrate 100 exposed by the nozzle 122' is first anisotropically etched to form a groove having a predetermined depth, and then a predetermined material layer, e.g., a tetraethylorthosilicate (TEOS) oxide layer, is deposited to a thickness of about 1 $\mu$m on the inner surface of the groove. Subsequently, the TEOS oxide layer is etched for removal, thereby forming the nozzle guide 180 formed of a TEOS oxide layer on the inner surface of the groove. Next, the portion of the substrate 100 exposed on the bottom of the groove is isotropically etched, thereby forming the ink chamber 114 having the nozzle guide 180 provided on an upper portion thereof, as shown in FIG. 6.

Figure 7:
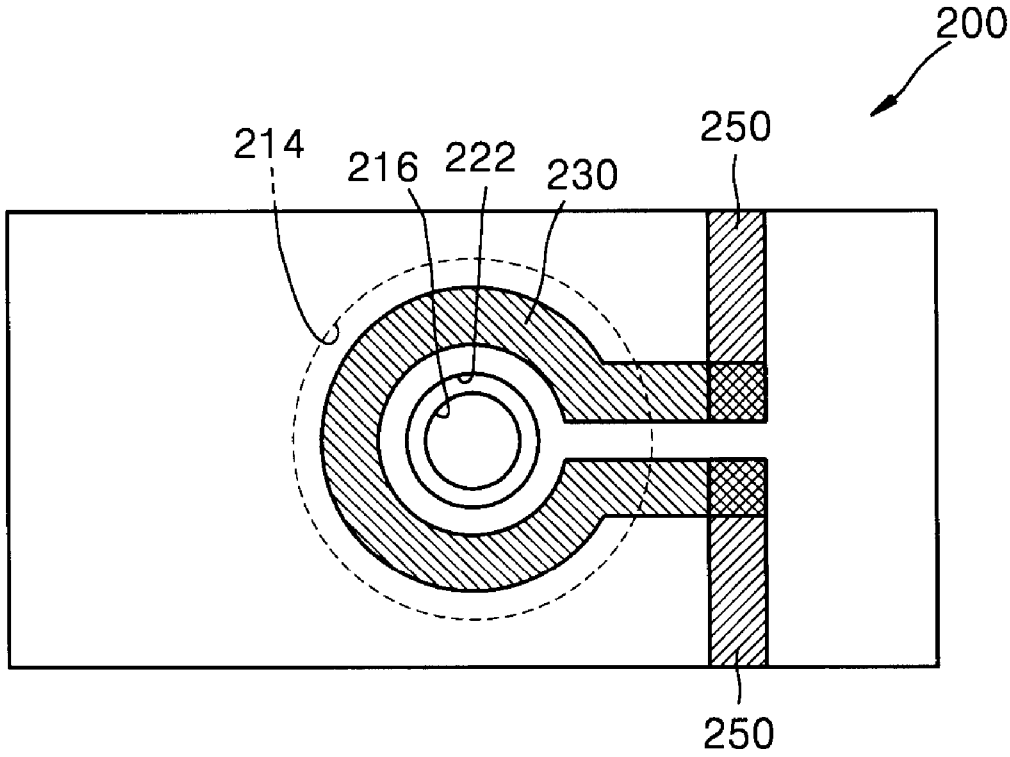
FIG. 7 illustrates a plan view of a modification of the ink ejector according to an embodiment of the present invention.

FIG. 7 illustrates a plan view illustrating another embodiment of an ink ejector 200 according to the present invention. Referring to FIG. 7, a heater 230 of an ink ejector 200 is formed substantially in the shape of the Greek letter omega, and electrodes 250 are connected to both ends of the heater 230. In other words, whereas the heater shown in FIG. 4 is connected between the electrodes in parallel, the heater 230 shown in FIG. 7 is connected between the electrodes 250 in series. The structures and arrangements of other components of the ink ejector 200, including an ink chamber 214, an ink channel 216 and a nozzle 222, are the same as those of the ink ejector shown in FIG. 4. The ink ejector 200 of this embodiment is also similar to the embodiment of FIG. 4 in that an anti-wetting coating is formed on the outer surface of the ink ejector 200.

Hereinafter, the ink ejection mechanism of an inkjet printhead according to an embodiment of the present invention will be described.

Figure 8A:
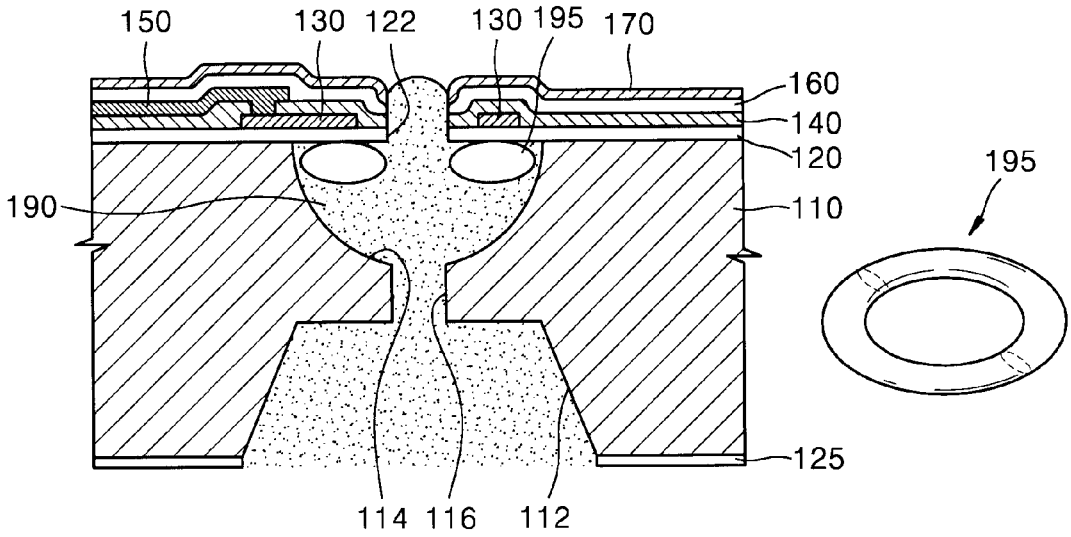
FIGS. 8A and 8B illustrate cross-sectional views of the ink ejection mechanism of the ink ejector illustrated in FIG. 5.
Figure 8B:
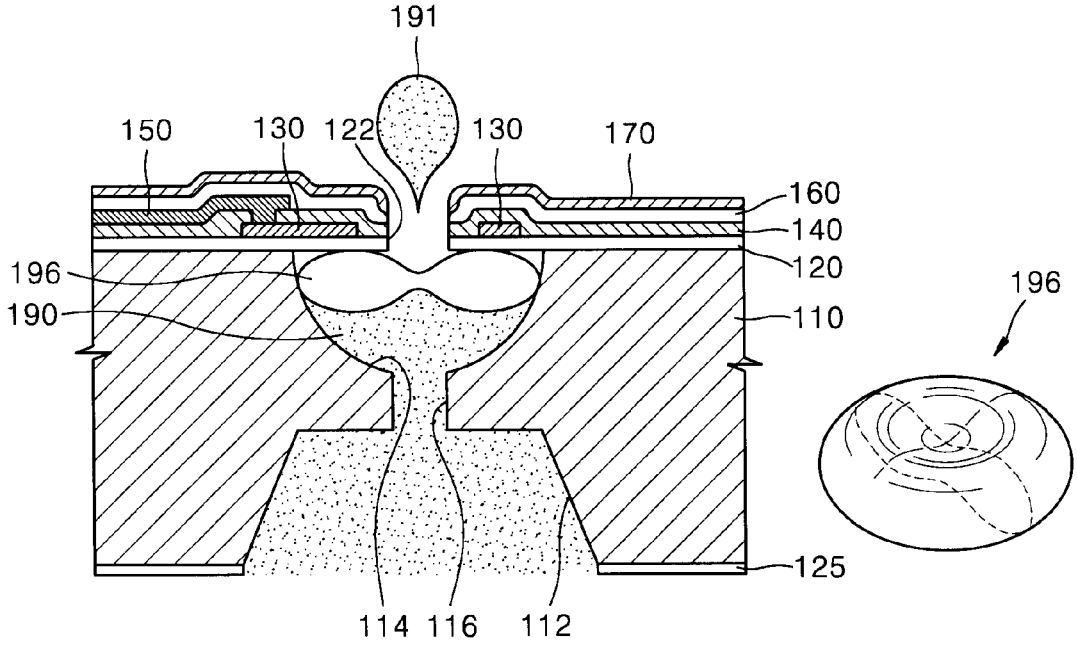

FIGS. 8A and 8B illustrate cross-sectional views of the ink ejection mechanism of the ink ejector illustrated in FIG. 5.

First, referring to FIG. 8A, ink 190 is supplied to the ink chamber 114 via the manifold 112 and the ink channel 116 by a capillary action. If pulse current is applied to the heater 130 by the electrodes 150 in a state where the ink chamber 114 is filled with ink 190, the heater 130 generates heat, and the heat is transmitted to the ink 190 via the nozzle plate 120 disposed under the heater 130. Accordingly, the ink 190 begins to boil, and a bubble 195 is generated. The bubble 195 is substantially annular shaped according to the shape of the heater 130, as illustrated to the right of FIG. 8A.

As time passes, the annular bubble 195 continues to expand so that it changes into a substantially disk-shaped bubble 196 having a slightly recessed center. At the same time, an ink droplet 191 is ejected, by the expanding bubble 196, from the ink chamber 114 via the nozzle 122.

When the current applied to the heater 130 is cut-off, the bubble 196 cools. Accordingly, the bubble 196 may begin to contract or burst, and the ink chamber 114 may be refilled with ink 190.

As described above, according to the ink ejection mechanism of the inkjet printhead, the tail of the ink droplet 191 to be ejected is cut by the disk-shaped bubble 196 transformed from the annular-shaped bubble 195, thereby preventing generation of small satellite droplets. In addition, the expansion of the bubbles 195 and 196 is restricted within the ink chamber 114. Accordingly, the ink is prevented from flowing backward, so that cross-talk between adjacent ink ejectors can be prevented. Moreover, in the case where the diameter of the ink channel 116 is smaller than that of the nozzle 122, it is possible to prevent backflow of ink more effectively.

In addition, since the heater 130 is formed in a ring shape or an omega shape, it has an enlarged area. Accordingly, the time taken to heat or cool the heater 130 may be reduced, so that the period of time ranging from a time when the bubbles 195 and 196 first appear to a time when they collapse can be shortened. Accordingly, the heater 130 can have a high response rate and a high driving frequency. In addition, the ink chamber 114 of a hemispherical shape has a more stable path for expansion of the bubbles 195 and 196 than a conventional ink chamber of a rectangular solid or pyramid shape.

In particular, since the outer surface around the nozzle 122 is treated with an anti-wetting film, which has a larger contact angle, it is possible to form an ink droplet 191 in a more stable manner and to eject the ink droplet 191 more precisely. In addition, ink or foreign material is not easily stained on the surface around the nozzle 122, and even if it is stained, it may be easily removed.

Figure 9A:
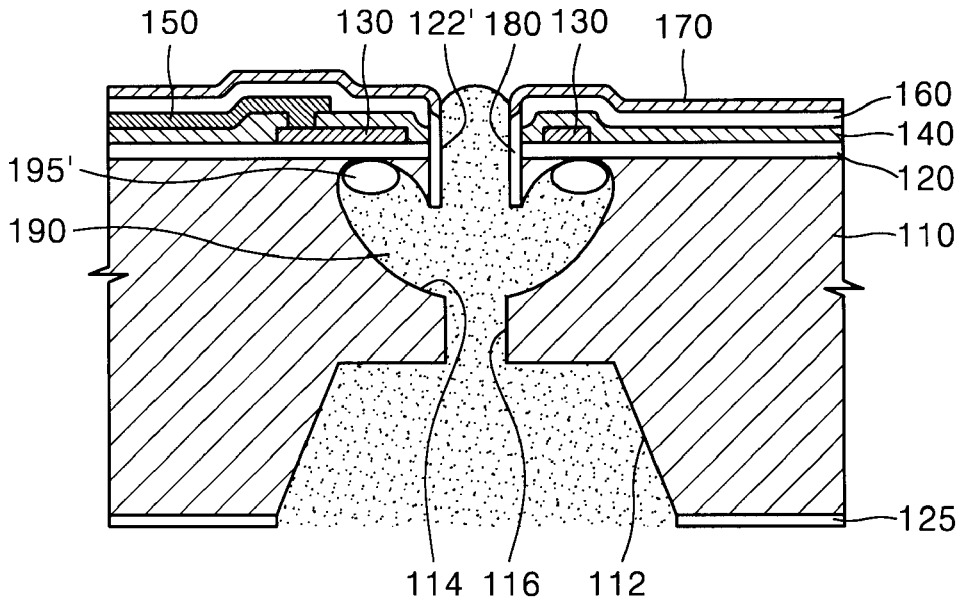
FIGS. 9A and 9B illustrate cross-sectional views of the ink ejection mechanism of the ink ejector illustrated in FIG. 6.
Figure 9B:
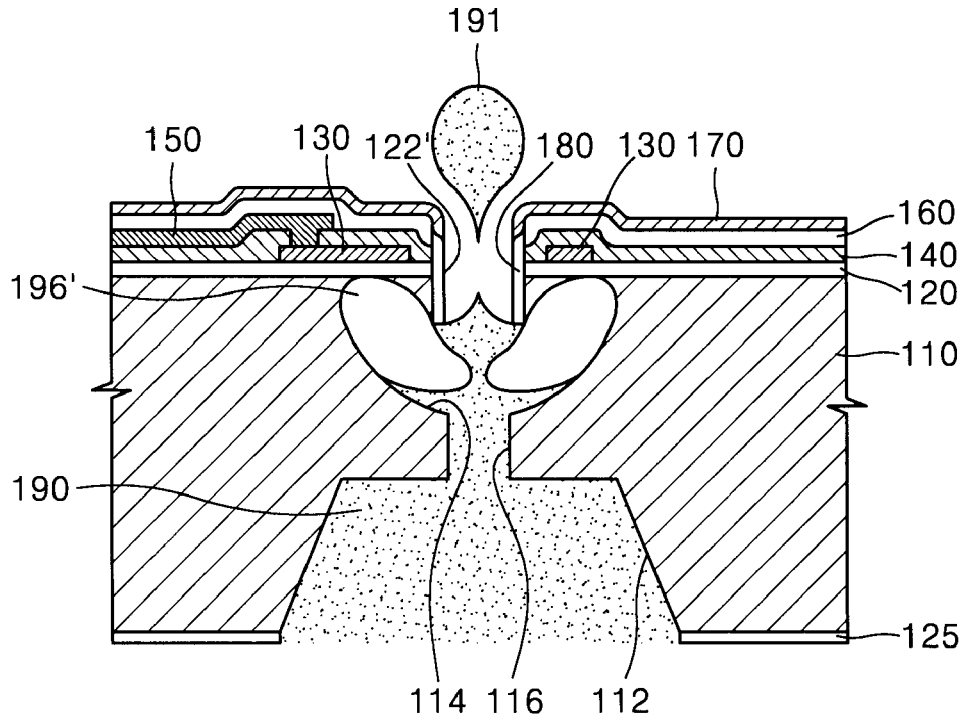

FIGS. 9A and 9B illustrate cross-sectional views of the ink ejection mechanism of the ink ejector illustrated in FIG. 6.

Referring first to FIG. 9A, since the ink ejection mechanism is similar to the above-described embodiment, only the differences will be described here. If pulse current is applied to the heater 130 by the electrodes 150 in a state where the ink chamber 114 is filled with the ink 190, the heater 130 generates heat, and the heat is transmitted to the ink 190. Accordingly, the ink 190 begins to boil, and a substantially annular shaped bubble 195' is generated.

As time passes, the annular bubble 195' continues to expand. As illustrated in FIG. 9B, since the nozzle guide 180 is formed in the ink ejector of this embodiment, there is little possibility that the bubbles 196' will coalesce below the nozzle 122'. However, the possibility that the expanding bubbles 196' will merge under the nozzle 122 may be controlled by controlling the length by which the nozzle guide 180 extends downward. In particular, according to this embodiment of the present invention, the direction of ejection of the droplet 191 ejected by the expanding bubble 196' is guided by the nozzle guide 180 so that the droplet 191 may be precisely ejected in a direction perpendicular to the substrate 110.

As described above, the bubble-jet type inkjet printhead according to the present invention has the following effects.

First, since an anti-wetting film having a perfluorinated alkene compound provided on the outer surface of a printhead around a nozzle has a relatively large contact angle, ink ejection can be made in a more stable manner and more accurately. Thus, the reliability and print quality of the inkjet printhead is improved.

Second, since bubbles are formed in an annular shape and an ink chamber is hemispherical in shape, backflow of ink can be suppressed, thereby preventing cross-talk between adjacent ink ejectors and suppressing generation of satellite droplets.

Third, since a substrate, in which a manifold, an ink chamber, and an ink channel are formed, a nozzle plate, and a heater are incorporated on a silicon substrate, the inconvenience of the prior art, in which a nozzle plate, an ink chamber, and an ink channel are separately manufactured and then are bonded together, and the attendant problem of misalignment, is obviated. In addition, general processes for manufacturing semiconductor devices can be directly applied to the manufacture of a bubble-jet type inkjet printhead according to the present invention, and thus mass production of the printhead may be facilitated.

While the present invention has been particularly shown and described with reference to preferred embodiments thereof, it will be understood by those of ordinary skill in the art that various changes in form and details may be made therein without departing from the spirit and scope of the invention as defined by the appended claims. For example, the elements of the printhead according to the present invention may be formed of different materials, which are not mentioned in the specification. The substrate may be formed of a material having good processability, instead of silicon. Similarly, the heater, the electrode, the silicon oxide layer, and the nitride layer may be formed from varying materials. In addition, the methods for depositing materials and forming elements suggested above are provided only for exemplary illustration. Various deposition methods and etching methods may be employed within the scope of the present invention.

What is claimed is:

1. A bubble-jet type inkjet printhead comprising:

a substrate, in which a manifold for supplying ink, an ink chamber having a substantially hemispherical shape and filled with ink to be ejected, and an ink channel for supplying ink from the manifold to the ink chamber, are incorporated;

a nozzle plate, formed on the substrate, having a nozzle, through which ink is ejected, the nozzle formed at a location corresponding to the center of the ink chamber;

a heater provided on the nozzle plate and surrounding the nozzle;

a nozzle guide extending downward in depth direction of the ink chamber formed at an edge of the nozzle; and electrodes provided on the nozzle plate and electrically connected to the heater to supply pulse current to the heater, wherein an anti-wetting coating including a perfluorinated alkene compound on at least a surface around the nozzle is formed on an exposed surface of the printhead.

2. The bubble-jet type inkjet printhead as claimed in claim 1, wherein the perfluorinated alkene compound is perfluorobutene.

3. The bubble-jet type inkjet printhead as claimed in claim 1, wherein the anti-wetting coating is deposited by RF glow discharge.

4. The bubble-jet type inkjet printhead as claimed in claim 1, wherein the anti-wetting coating can be removed by $O_2$ plasma.

5. The bubble-jet type inkjet printhead as claimed in claim 1, wherein an insulation layer is formed on the nozzle plate where the heater is formed, and the electrodes are formed on the insulation layer.

6. The bubble-jet type inkjet printhead as claimed in claim 5, wherein the insulation layer is a silicon nitride layer.

7. The bubble-jet type inkjet printhead as claimed in claim 5, wherein the insulation layer has a depth of about 0.5 $\mu$m.

8. The bubble-jet type inkjet printhead as claimed in claim 5, wherein a passivation layer is formed over the electrodes and the insulation layer, and the anti-wetting coating is formed on the passivation layer.

9. The bubble-jet type inkjet printhead as claimed in claim 8, wherein the passivation layer is a silicon oxide layer or a silicon nitride layer.

10. The bubble-jet type inkjet printhead as claimed in claim 1, wherein the manifold is formed on a bottom side of the substrate, and the ink channel is formed on a bottom of the ink chamber to be in flow communication with the manifold.

11. The bubble-jet type inkjet printhead as claimed in claim 1, wherein the heater is annular-shaped, and the electrodes are connected to opposite locations of the heater on the diameter thereof.

12. The bubble-jet type inkjet printhead as claimed in claim 1, wherein the heater is formed in the shape of the Greek letter omega and the electrodes are connected to both ends of the heater.

13. The bubble-jet type inkjet printhead as claimed in claim 1, wherein the ink chamber having a substantially hemispherical shape has a depth and radius of about 20 $\mu$m.

* * * * *